US005564581A

United States Patent [19]

Lin

[11] Patent Number: 5,564,581

[45] Date of Patent: Oct. 15, 1996

[54] VACUUM CANISTER

[75] Inventor: Ming-Te Lin, Tainan City, Taiwan

[73] Assignee: Pi-Chu Lin, Hsien, Taiwan

[21] Appl. No.: 518,445

[22] Filed: Aug. 23, 1995

[51] Int. Cl.[6] ..... B65D 51/16; B65D 55/00

[52] U.S. Cl. ..... 215/228; 220/231

[58] Field of Search ..... 215/228, 386, 215/400; 220/231, 212; 141/25–28, 65; 137/522, 854

[56] References Cited

U.S. PATENT DOCUMENTS

| | | | |
|---|---|---|---|
| 347,095 | 8/1886 | Doherty | 215/228 |
| 4,278,114 | 7/1981 | Ruberg . | |
| 4,524,877 | 6/1985 | Saxby et al. | 215/228 |
| 4,768,665 | 9/1988 | Ballas | 215/228 |
| 4,889,250 | 12/1987 | Beyer | 215/228 |
| 5,294,010 | 3/1994 | Tschida | 215/386 X |
| 5,347,918 | 9/1994 | Chen . | |
| 5,405,038 | 4/1995 | Chuang | 215/228 X |
| 5,449,079 | 9/1995 | Yang | 215/228 |

*Primary Examiner*—Allan N. Shoag
*Assistant Examiner*—Nathan Newhouse
*Attorney, Agent, or Firm*—Panitch, Schwarze, Jacobs & Nadel, P.C.

[57] ABSTRACT

A vacuum canister comprises a container section and a cover with an integrally formed air suction device. The air suction device includes a sleeve pipe, an eduction membrane and a piston tube. One end of the sleeve pipe has an anchor plate and a grating plate. A flexible eduction membrane is located between the anchor plate and the grating plate, and fastened to the anchor plate. The anchor plate has a flow hole therethrough and the grating plate has an air hole therethrough. The membrane is movable between a first position in which the membrane allows airflow through the air hole and a second position in which the membrane blocks airflow through the air hole. The piston tube is received by, and moves within, the sleeve pipe. One end of the piston tube has a front retaining edge, a rear retaining edge, and a flexible O-ring movable therebetween. The front and rear retaining ends are separated by an interval of space. The O-ring has a thickness smaller than the interval of space. The piston tube also has a relief hole formed therethrough along a portion of the interval of space. The O-ring moves within the interval of space between a first position in which the O-ring blocks airflow through the relief hole and a second position in which the O-ring does not block airflow the relief hole. The piston tube further has an overflow hole near its other end for ultimately expelling air from the canister.

4 Claims, 6 Drawing Sheets

VACUUM CANISTER

BACKGROUND OF THE INVENTION

1. Field of the Invention

The invention herein relates to a vacuum canister that is simple to manufacture and does not require the addition of extraneous structural devices on the cover. Vacuum can be produced through a direct manual operation.

2. Description of the Related Art

Utilizing containers to hold food stuff is a common practice in a majority of households. However, since the sealing capabilities of a container directly affects the storage period of the foodstuff enclosed within, therefore, a large number of so-called "vacuum canister" containers available on the market have been welcomed by consumers for utilization, wherein the operating principles are not based on having a perfect vacuum inside the container, but the drawing out of the air inside the container after the food has been placed within, thereby causing the production of an internal negative pressure by reducing the quantity of air inside the container to increase the storage period of the food. Furthermore, the negative pressure inside the container increases the sealing strength of the cover and the container of the aforesaid vacuum canister.

Referring to FIG. 1, a currently observed conventional vacuum canister generally has an empty container section (1) and a cover (2), of which there is a curved hook-shaped hinge (11) on one side of the container section (1) and a latch mount (12) on the opposite side. The cover (2) rests against the tabs (21) of the hinge (11) as well as the hinge (11) itself, and the cover, furthermore, is latched onto the catch plate (22) of the latch mount (12) such that the cover (2) and container section (1) are in an encapsulated state. The upper extent of the cover (2) has a recess hole (23). There is an annular channel (24), along the inner circumference of the recess hole (23), and a straight channel (25) at the center of the recess hole (23). Furthermore, there is an air hole (26) near the straight channel (25) at the lower extent of the recess hole (23).

A gasket (3) constructed of a flexible material has a circular section (31) that corresponds to the annular channel (24) in the cover (2), and a rib section (32) that can be inserted into the straight channel (25) in the cover (2). Furthermore, the rib section (32) has a membrane piece (33) that covers the air hole (26) on the cover (2).

A suction device (4) includes an end having a lip (41) protruding inward into the empty area within and another end that is a pipe opening (42) of a sleeve pipe (43); a handle (44) formed into one end of the sleeve pipe (43) and piston rod (46) of a piston (45) at the other end; a slot port (47) formed onto the aforesaid piston rod (46) and the form of the piston (45) consists of an interval (451) the lower extent and front which separates a front retaining edge (452) and a rear retaining edge (453). Furthermore, there is a flexible O-ring (454) in between the front retaining edge (452) and the rear retaining edge (453), and the outer diameter of the O-ring (454) tightly, accommodates the inner diameter of the sleeve pipe (43). The diameter of the O-ring (454) does not fully occupy the entire space of the interval (451), which thereby enables the O-ring (454) to be movable in between the front retaining edge (452) and the rear retaining edge (453). A minor interval remains because the outer diameters of both the front retaining edge (452) and the rear retaining edge (453) are smaller than the inner diameter of the sleeve pipe (43). Furthermore, there is a vent hole (455) in the area where the piston rod (46) and slot port (47) converge with the rear retaining edge (453).

When a conventional vacuum canister is utilized, as indicated in FIG. 2 the cover (2) is placed onto the container section (1). When the catch plate (22) is locked to the latch mount (12) for sealing, the gasket (3) is inserted into the recess hole (23), whereupon the circular section (31) is correspondingly inserted into the annular channel (24) of the cover (2) and the rib section (32) is correspondingly inserted into the straight channel (25) of the cover (2), at which time the membrane piece (33) on the rib section (32) enshrouds the air hole (26) on the cover (2). The pipe opening (42) of the sleeve pipe (43) extending from the suction device (4) is flush against the gasket (3) seated in the recess hole (23) in the cover (2). Then, the handle (44) is reciprocated. When the handle (44) is pulled upwards, the air inside the container section (1) is drawn upward by the action of the flexible membrane piece (33) through the air hole (26) in the recess hole (23) of the cover (2) and enters the sleeve pipe (43), at which time the O-ring (454) is moved towards the front retaining edge (452) and lodged within the interval between the front retaining edge (452) and the sleeve pipe (43). Therefore, the air drawn out of the container section (1) resides in the space between the piston (45) and the gasket (3) of the sleeve pipe (43). When the handle (44) is pushed downwards, as indicated in FIG. 3, the O-ring (454) is displaced towards the rear retaining edge (453) and, after separating from the former sealed disposition, leaves an interval between the rear retaining edge (453) and the sleeve pipe (43) without, however, unplugging the vent hole (455) in the rear retaining edge (453). Therefore, the aforesaid air drawn into and pressurized within the confines between the piston (45) and the gasket (3) of the sleeve pipe (43) at this time by the action of the membrane piece (33) can only pass through the interval between the front retaining edge (452) and the sleeve pipe (43) and the vent hole (455) in the rear retaining edge (453) for discharge of the overflow through the slot port (47). When the handle (44) is repeatedly pulled and pressed, such that air inside the container section (1) is only expelled and not inducted, a negative pressure is gradually produced within the container section (1), at which time, the movement of the suction device (4) is separated from the membrane piece (33) such that the cover (2) cannot be removed even when the catch plate (22) is unlatched.

Although the foregoing method of producing a vacuum inside a vacuum canister is widely utilized, the position and operation of the suction device (4) is not of ideal design. In use, (a) the vacuum canister cannot be employed if the user loses or is unable to find the suction device, and (b) when suctioning air, the suction device must be steadied with the other hand so the pipe opening of the sleeve pipe is held firmly against the gasket. Otherwise, there will be gaps between the pipe opening and the gasket that render suction impossible to achieve.

SUMMARY OF THE INVENTION

The objective of the invention herein is to provide a kind of improved vacuum canister that includes a container section and a cover and at the upper extent of the cover is an air suction device and an air plug, of which the aforesaid air suction device on the aforesaid cover is mainly comprised of a sleeve pipe and within the aforesaid sleeve pipe is a piston tube; wherein, at one end inside the aforesaid sleeve pipe is an interval that is formed by an anchor plate and a grating plate; the aforesaid anchor plate and the aforesaid grating plate each have air holes and flow holes, and in between the aforesaid anchor plate and the aforesaid grating plate is an eduction membrane constructed of a flexible material, and the head of the aforesaid eduction membrane is fastened onto the aforesaid anchor plate; inside the other end of the aforesaid sleeve pipe is a lip; an air passage is formed through the empty interior of the aforesaid sleeve pipe and within the equal interval of movement inside one end is a front retaining edge and a rear retaining edge; cut into the aforesaid piston tube at the aforesaid interval of movement is a relief hole and a flexible O-ring is mounted on the aforesaid piston tube and, furthermore, the diameter of the aforesaid O-ring is smaller than the width of the aforesaid interval of movement to enable the aforesaid O-ring to be moved into position between the aforesaid front retaining edge and the aforesaid rear retaining edge; at the other end of the aforesaid piston tube is a pull handle and, furthermore, near the aforesaid pull handle of the aforesaid piston tube is an overflow hole, such that when the piston tube of the aforementioned structure is moved in reciprocal motion, a negative pressure is produced inside the container section.

BRIEF DESCRIPTION OF THE DRAWINGS

Other features and advantages of the invention herein will become apparent in the following detailed description of the preferred embodiments, with reference to the accompanying drawings, of which.

DETAILED DESCRIPTION OF THE INVENTION

Figure 1:
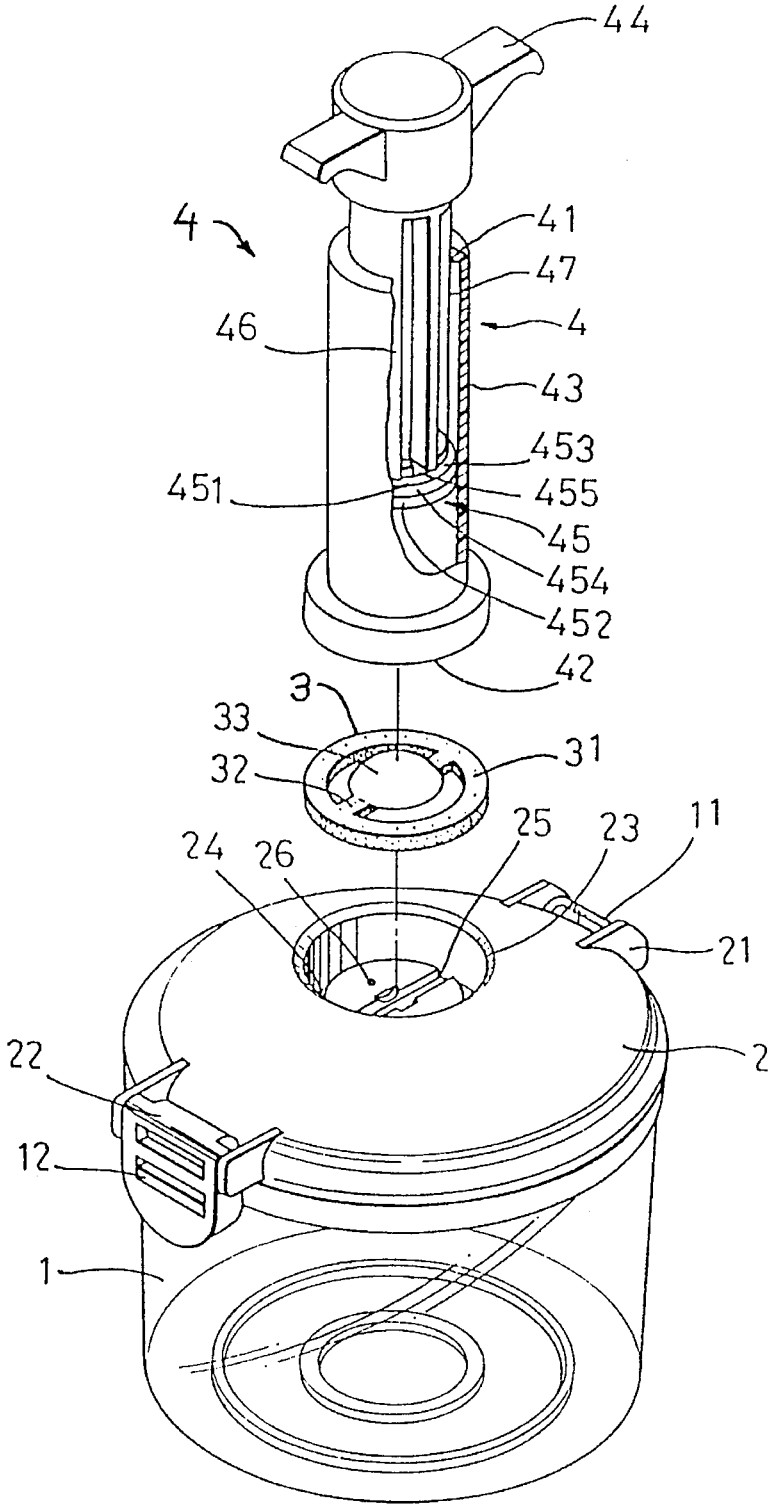
FIG 1 PRIOR ART
FIG. 1 is an exploded isometric drawing of a conventional vacuum canister.
Figure 2:
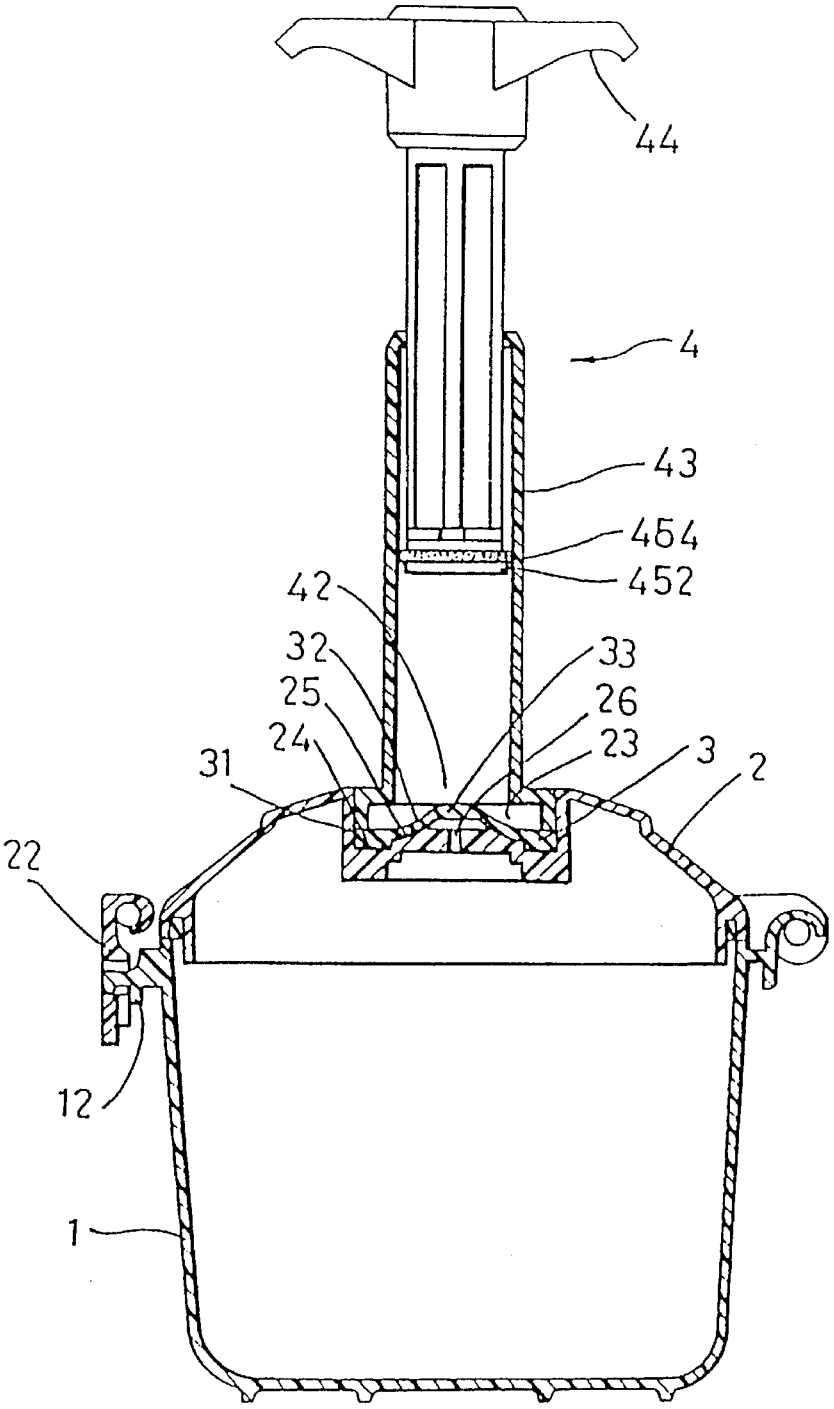
FIG 2 PRIOR ART
FIG. 2 is a cross-sectional drawing of the conventional vacuum canister in FIG. 1 showing its suction device in a first position.
Figure 3:
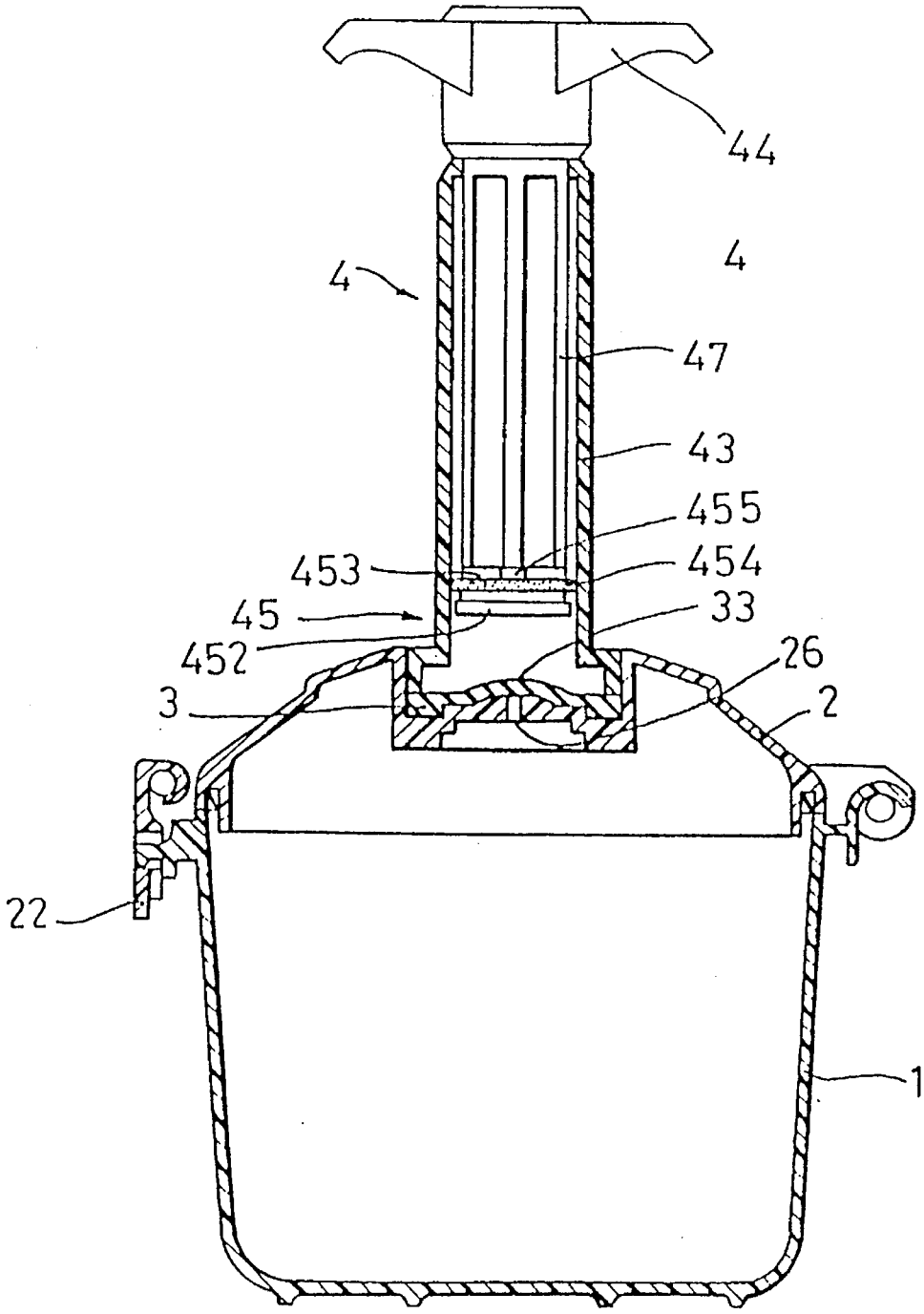
FIG 3 PRIOR ART
FIG. 3 is a cross-sectional drawing of the conventional vacuum canister in FIG. 1 showing its suction device in a second position.

In the detailed description of the preferred embodiments of the vacuum canister herein, similar elements are indicated by the same reference numerals throughout the disclosure.

Figure 4:
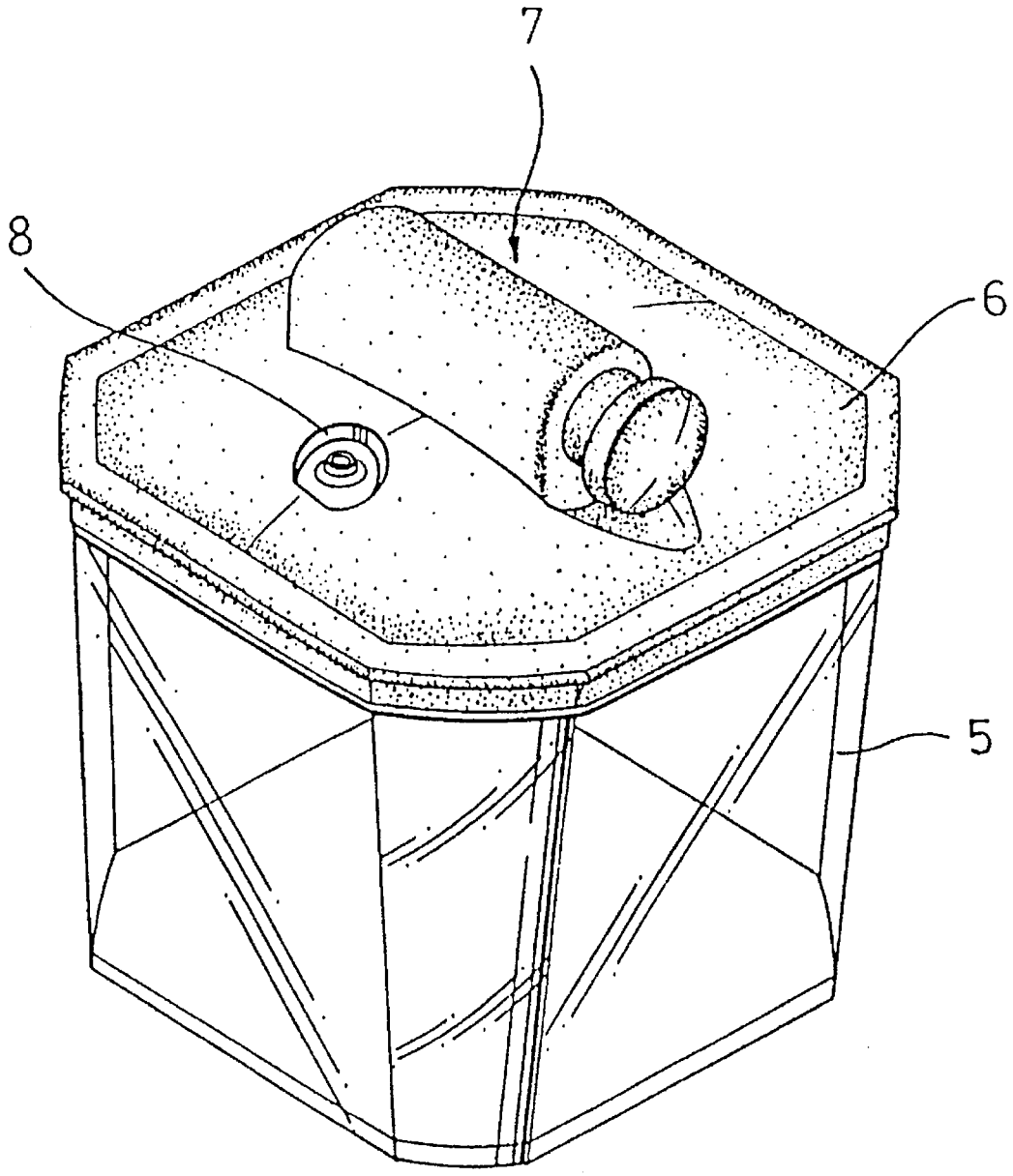
FIG. 4 is an isometric drawing of the preferred embodiment of the invention herein.
Figure 5:
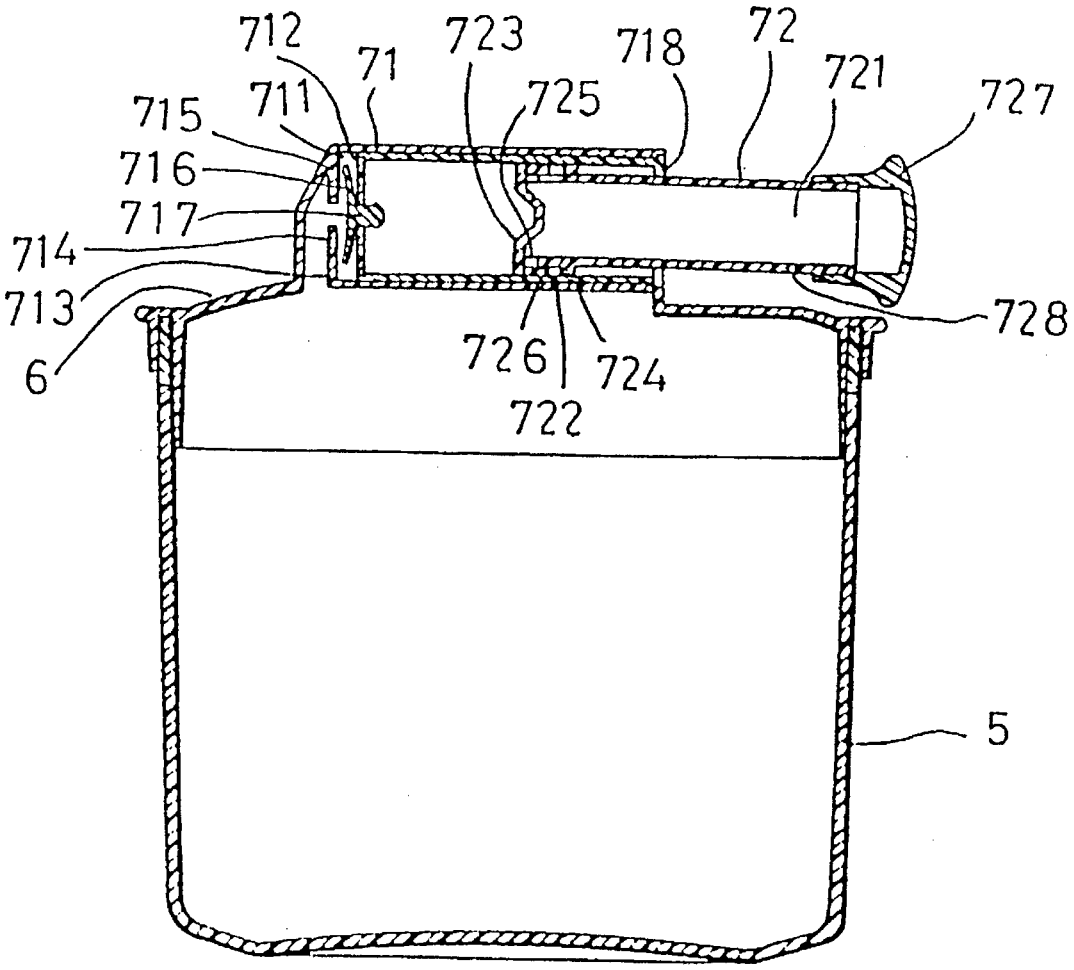
FIG. 5 is a cross-sectional drawing of the preferred embodiment of the invention of FIG. 4 showing its suction device in a first position.

Referring to FIG. 4, the preferred embodiment of the invention herein has a container section (5) and a cover (6). There is an air suction device (7) and an air plug (8) at the upper extent of the cover (6). The air suction device (7), as indicated in FIG. 5, on the cover (6) is mainly comprised of a sleeve pipe (71). A piston tube (72) is within the sleeve pipe (71). At one end inside the sleeve pipe (71) is an interval (711) that is formed by an anchor plate (712) and a grating plate (713). The anchor plate (712) and the grating plate (713) each have air holes (714) and flow holes (715). In between the anchor plate (712) and the grating plate (713) is a eduction membrane (716) constructed of a flexible material. Head (717) of the eduction membrane (716) is fastened onto the anchor plate (712). A lip (718) is inside the other end of the sleeve pipe (71).

An air passage (721) is formed through the empty interior of the sleeve pipe (71). Within an equal interval of movement (722) inside one end of the interior is a front retaining edge (723) and a rear retaining edge (724). A relief hole (725) is cut into the piston tube (72) of the interval of movement (722). A flexible O-ring (726) is mounted on the piston tube (72). The diameter of the O-ring (726) is smaller than the width of the interval of movement (722) to enable the O-ring (726) to be moved into position in between the front retaining edge (723) and the rear retaining edge (724). A pull handle (727) is at the other end of the piston tube (72). An overflow hole (728) is near the pull handle (727) of the piston tube (72).

Figure 6:
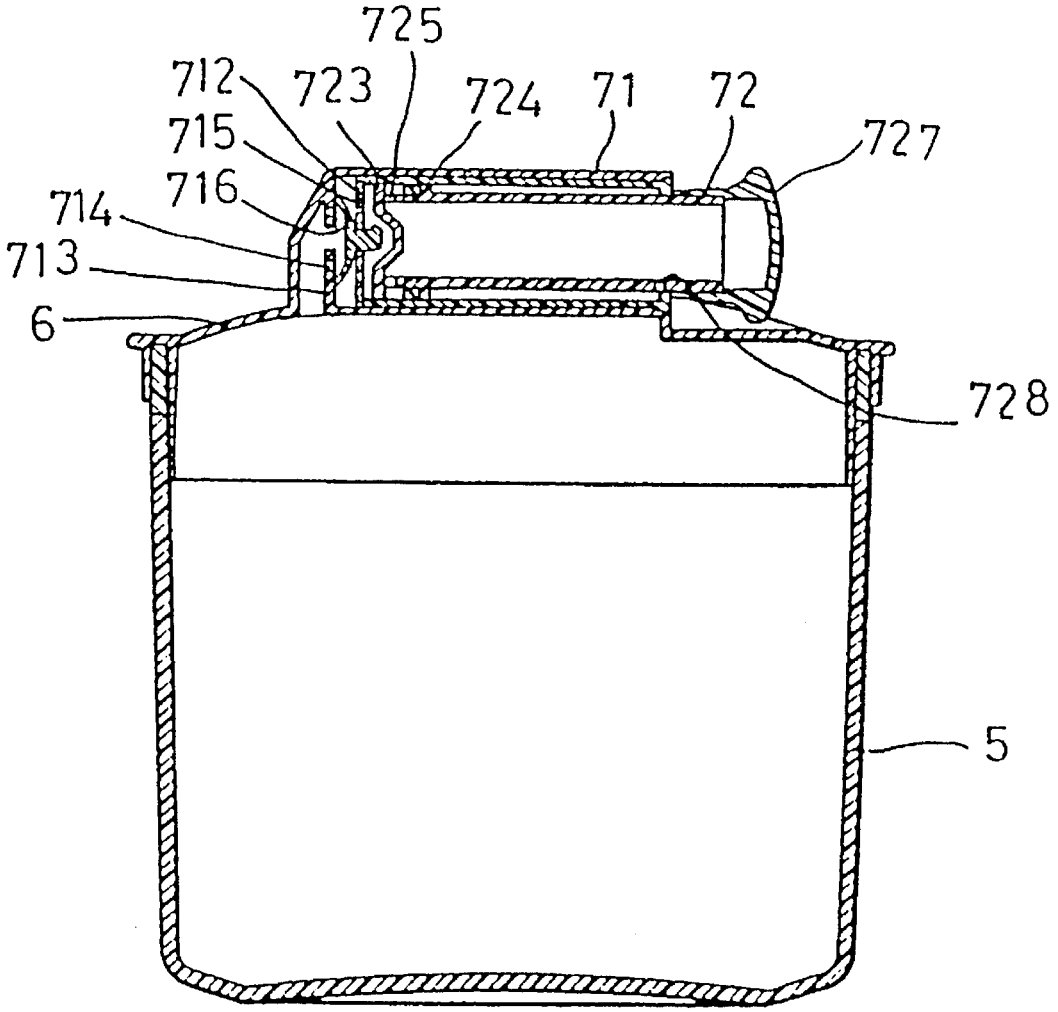
FIG. 6 is a cross-sectional drawing of the preferred embodiment of the invention of FIG. 4 showing its suction device in a second position.

During use, the cover (6) is on the container section (5) and the pull handle (727) is pushed and pulled. When the pull handle (727) is pulled in an outward movement, the O-ring (726) blocks the relief hole (725) and the interval in between the front retainer edge (723) and the sleeve pipe (71), at which time the negative pressure causes the air in the container section (5) to be drawn by the action of the eduction membrane (716) through the air holes (714) in the grating plate (713) and through the flow holes (715) in the anchor plate (712) onto the front retaining edge (723) of the piston tube (72) in between the anchor plate (712) and the piston tube (72). When the pull handle (727) is pushed in an inward movement, as indicated in FIG. 6, since the O-ring (726) is lowered at this time against the rear retaining edge on the piston tube (72), the air in the sleeve pipe (71) in between the anchor plate (712) and the piston tube (72) passes through the flow holes (715) on the anchor plate (712) to push the eduction membrane (716) against, and thereby block, the air holes (714) on the grating plate (713), while additionally passing through the interval in between the front retaining edge (723) and the sleeve pipe (71), as well as through the relief holes (725) on the piston tube (72) into the piston tube (72). The air is finally discharged through the overflow hole (728) near the pull handle (727) on the piston tube (72). Since the air in the container section (5) is only expelled without allowing any further intake, a negative pressure is formed inside the container section (5) which enables the cover (6) to have superior sealing capability and, furthermore, enables the contents within the vacuum canister of the invention herein to avoid prolonged contact with air and thereby not deteriorate. To open the cover (6), it is only necessary to remove the air plug (8) on the cover (6), as indicated in FIG. 4, whereupon air outside the vacuum canister of the invention herein is drawn in by the negative pressure until the internal and external air pressure is equalized, which enables the removal of the cover (6).

Based on the foregoing structural description, it can be understood that the structure of the vacuum canister invention herein completely eliminates the difficulty associated with mounting an external air suction device and, furthermore, precludes the conventional necessity of utilizing another hand to hold the device while applying downward pressure to the pump to prevent leakage from the gasket in between the sleeve pipe and the sleeve pipe opening.

While the invention herein has been described in connection with what is considered the more practical and preferred embodiments, it shall be understood that the invention herein is not limited to the disclosed embodiments, but is intended to cover the various arrangements within the spirit and the scope of the broadest interpretations and equivalent configurations.

What is claimed is:

1. A vacuum canister comprising a container section and a cover, the cover having an air suction device integrally formed on an upper surface thereof for creating vacuum in the canister, the air suction device including:

(a) a sleeve pipe, a first interior end of the sleeve pipe having an anchor plate and a grating plate separated by a first interval, the anchor plate having at least one flow hole therethrough and the grating plate having at least one air hole therethrough, the air hole being in fluid communication with the container section;

(b) an eduction membrane constructed of a flexible material, the membrane being located in the first interval between the anchor plate and the grating plate, the membrane being fastened at one end to the anchor plate, the membrane being movable between a first position in which the membrane allows airflow through the air hole and a second position in which the membrane blocks airflow through the air hole; and (c) a piston tube received by the sleeve pipe and movable toward and away from the anchor plate, one end of the piston tube having a front retaining edge, a rear retaining edge, and a flexible O-ring disposed therebetween, the front and rear retaining edges being separated by a second interval, the O-ring having thickness less than the second interval, the piston tube also having a relief hole formed therethrough along a portion of the second interval, the O-ring being movable within the second interval between a first position in which the O-ring is adjacent to the front retaining edge and blocks airflow through the relief hole and a second position in which the O-ring is adjacent to the rear retaining edge and does not block airflow through the relief hole, the piston tube further having an overflow hole near the other end, opposite the one end, wherein when the cover is placed on the container section, outward movement of the piston tube causes the membrane and the O-ring to be placed in their respective first positions so that air from the container section flows through the air hole and flow hole and into the interior of the sleeve pipe between the anchor plate and the front retaining edge of the piston tube, and movement of the piston tube toward the first interior end of the sleeve pipe causes the membrane and O-ring to be placed in their respective second positions so that air from the interior of the sleeve pipe flows through the relief hole, into the piston tube and out of the piston tube through the overflow hole.

2. A vacuum canister according to claim 1 wherein the other end of the piston tube has a pull handle.

3. A vacuum canister according to claim 1 wherein the sleeve pipe has an inward lip opposite the first interior end, and the piston tube is movable between the anchor plate and the lip.

4. A vacuum canister according to claim 1 wherein the cover further has an air plug for releasing vacuum in the canister.

* * * * *